United States Patent [19]

Roca

[11] Patent Number: 4,639,959

[45] Date of Patent: Feb. 3, 1987

[54] WAVE GENERATOR FOR WATERBEDS

[76] Inventor: Abel Roca, 11480 SW. 131 St., Miami, Fla. 33176

[21] Appl. No.: 762,684

[22] Filed: Aug. 5, 1985

[51] Int. Cl.[4] ..... A47C 27/08; A47D 9/02; A61H 1/00

[52] U.S. Cl. ..... 5/451; 5/108; 128/33; 128/64

[58] Field of Search ..... 5/451, 109, 108; 128/33, 64; 4/491; 405/79

[56] References Cited

U.S. PATENT DOCUMENTS

| | | | |
|---|---|---|---|
| 3,392,723 | 7/1968 | Calvin | 128/33 |
| 3,529,311 | 9/1970 | Crawford | 5/109 |
| 3,758,156 | 9/1973 | Zawadzki | 5/109 |
| 3,872,526 | 3/1975 | Betts | 5/451 |
| 4,088,124 | 5/1978 | Korner et al. | 5/451 |
| 4,141,096 | 2/1979 | Hale et al. | 5/451 |
| 4,187,568 | 2/1980 | McMullan et al. | 5/451 |
| 4,228,793 | 10/1980 | Ramey | 128/33 |
| 4,231,126 | 11/1980 | Hurkett | 5/451 |

FOREIGN PATENT DOCUMENTS

| | | | |
|---|---|---|---|
| 732583 | 3/1943 | Fed. Rep. of Germany | 4/491 |
| 1592452 | 7/1981 | United Kingdom | 4/491 |

*Primary Examiner*—Gary L. Smith
*Assistant Examiner*—Carl M. DeFranco, Jr.
*Attorney, Agent, or Firm*—Erwin M. Barnett

[57] ABSTRACT

A wave generator for waterbeds comprises a paddle unit adapted for positioning on the horizontal mattress supporting surface of the bed frame between an edge of the mattress and a side panel of the frame and has a paddle extending to overlie the upfacing surface of the mattress. A pivoted arm supports the paddle and is reciprocated by an electric motor through pitman-like linkages to oscillate from a raised horizontal position to a downwardly inclined position whereby the paddle rhythmically depresses and releases the mattress creating waves in the surface thereof radiating from the paddle. A control box having an on/off switch, a speed control for the motor and a timer for the switch is interposed along wiring from the motor. The length of wiring between the motor and control box being sufficient to locate the control box for easy access by a user reclining on the mattress when the paddle unit is in operative position.

13 Claims, 8 Drawing Figures

WAVE GENERATOR FOR WATERBEDS

BACKGROUND OF THE INVENTION

1. Field of the Invention

This invention relates to accessories for waterbeds and more particularly is directed to a wave generating device for imparting a wave-like motion to the surface of the water-filled mattress whereby a rocking motion characterized as a rising and falling sensation is experienced by persons lying on the mattress.

2. Description of the Prior Art

Waterbeds have been equipped with various devices for imparting vibrations to the water-filled mattress. Such vibration producing devices may apply the vibratory action to any portion of the mattress, preferably the bottom, and may be permanently attached to the base of the frame with the mattress resting thereon. These vibrations are of relatively high frequency and are intended to provide a massage of sorts to body portions of the user which are in contact with the mattress.

SUMMARY OF THE INVENTION

Among the objects of the invention is to provide a motorized, wave generating accessory for waterbeds which shall impart an undulating motion to the upfacing surface of the mattress rendering a rocking and restful sensation to those reclining thereon promoting relaxation and inducing sleep. The accessory shall comprise few and simple parts which include a motorized paddle unit and a remote control box interposed by electric wiring between the motor of the paddle unit and the home electric power, which paddle unit shall be easily installable by the user for immediate use by placement on the waterbed frame, embracing an edge of the mattress, and likewise be easily removable. The remote control box shall provide convenient accessibility to the user for on/off switching, shut-off timing and wave frequency adjustment.

The invention embodies an accessory for waterbeds each of which has a horizontal surface supporting a water-filled mattress and a frame surrounding the periphery of the mattress. The motorized paddle unit of the accessory, having an overall C-shaped configuration, comprises a housing having a lower chamber adapted to rest on the horizontal surface of the bed and a vertical chamber communicating with and extending upwardly from said lower chamber adapted to abut the frame of the bed. The upper end of the vertical chamber has an opening facing the mattress through which an arm extends, the arm being pivoted at one end to a support in the vertical chamber and carrying a paddle on the opposite free end adapted to overlie and engage the upper surface of the mattress adjacent an edge thereof. An electric motor is located in the lower chamber and a linkage drive means for converting rotary motion of the motor to reciprocating motion extends through the vertical chamber and connects the motor to the arm, pivoting the latter in a vertical plane between a substantially horizontal position and a downwardly inclined position enabling the paddle to rhythmically depress and release the mattress to create waves in the surface thereof radiating from the paddle.

DESCRIPTION OF THE PREFERRED EMBODIMENTS

Figure 1:
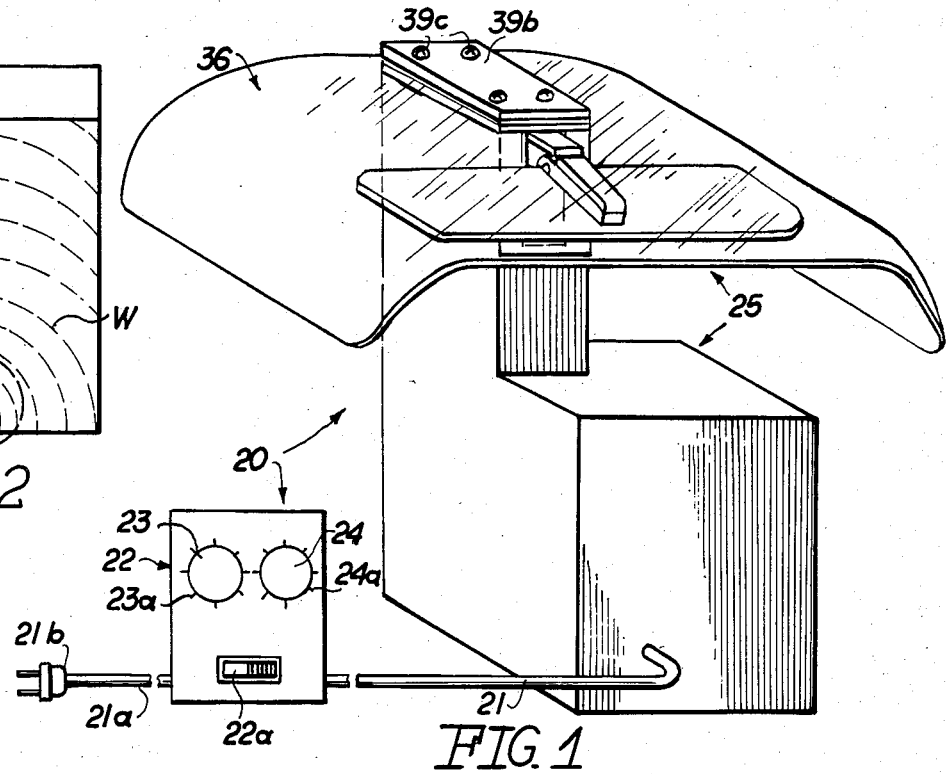
FIG. 1 is a rear perspective view of a wave generating accessory comprising a motorized paddle unit and control box therefor embodying the invention.

Referring in detail to the drawings, 20 generally denotes a wave generating accessory shown in FIG. 1 to include motorized paddle unit 25 connected by wiring 21 to control box 22 which in turn has wiring **21*a* terminating in a conventional plug 21*b*** for selectively connecting to a socket of the home electric power.

Paddle unit 25 comprises an electric motor 26 which rotates drive shaft 27 through reduction gearing 28, a pitman or connecting rod 29 between a crank **27*a*, which is mounted to turn with shaft 27, and a paddle assembly 30 which is driven by connecting rod 29 to reciprocate beneath protective shield 36. A housing 37 is seen to provide an enclosure for all the parts of paddle unit 25 except for a projecting portion of paddle assembly 30 and thus encloses a relatively large lower or base chamber 38 communicating with a relatively narrow vertical chamber 39. Housing 37** may be made of any suitable metal or plastic material and, where required, may be reinforced by any conventional means (not shown).

Electric motor 26 and reduction gearing 28 are located in base chamber 38 and are attached by suitable means, not shown, to the bottom wall **37*a* of housing 37. Electric motor 26 and reduction gearing 28 may be of any conventional type capable of operating drive shaft 27 at the desired RPM and providing power sufficient to enable paddle assembly 30 to depress the surface of mattress M for generating waves W. To this end, the location of crank 27*a* in chamber 38 enables connecting rod 29 to extend through vertical chamber 39 with connecting rod lower end 29***a* pivoting on pin 27*b* carried by crank 27*a* and the upper end 29*b* of rod 29 pivotally connected to a midportion of arm 31 whereby the rotary motion of shaft 27 is converted to vertically reciprocate paddle assembly 30.

Figure 3:
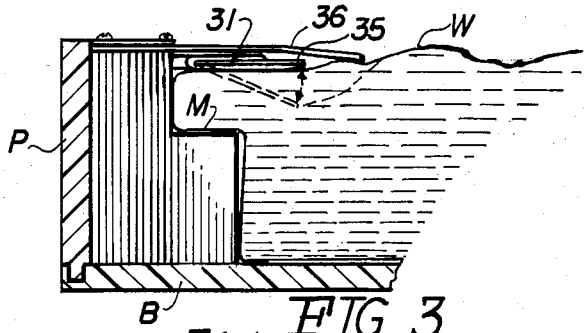
FIG. 3 is a fragmentary sectional view as seen on line 3—3 in FIG. 2 showing the paddle unit in operative position, the arm assembly and paddle being shown in raised position in full lines and in lowered, mattress depressing, position in broken lines.
Figure 6:
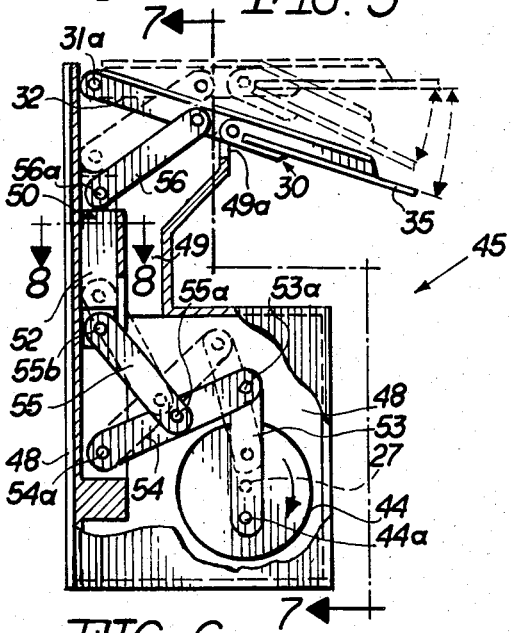
FIG. 6 is a side elevational view similar to FIG. 4 but with the top wall of the housing removed and showing a modified form of drive connection between the motor and reciprocating paddle, the arm assembly and paddle being shown in full lines in lowered, mattress depressing, position and in broken lines in fully raised position, the free downward pivoting of the rear arm section with respect to the front arm section also being indicated in broken lines.
Figure 4:
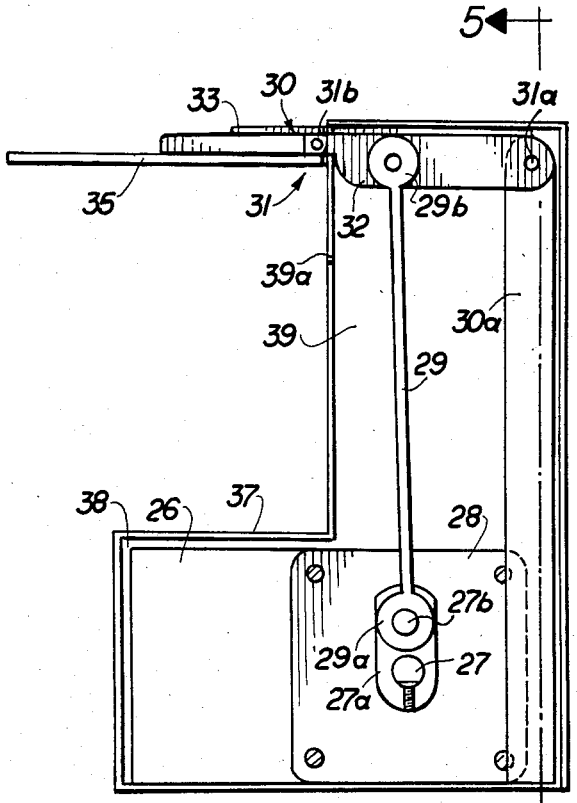
FIG. 4 is a side elevational view of the paddle unit of the accessory shown in FIG. 1 with the side wall of the housing removed to show the interior construction, the protective shield and retaining plate also being omitted.
Figure 5:
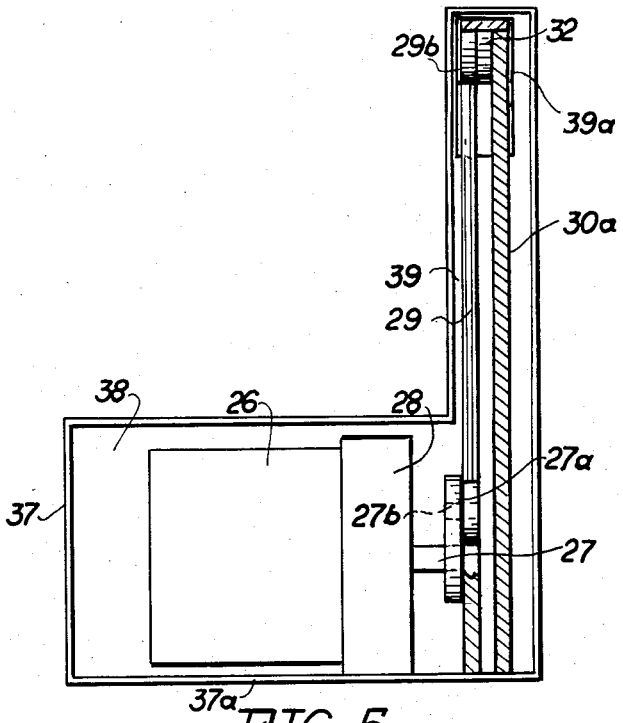
FIG. 5 is a front elevational view of the paddle unit shown in FIG. 4 with the front wall of the housing removed.

Paddle assembly 30 is located at the upper end of vertical chamber 39 and comprises pivoted arm 31 carrying paddle 35. Stanchion 30*a*, which upstands from bottom wall 37*a* and is located along the front wall of chamber 39, pivotally supports the front end of arm 31 by pivot pin 31*a*. Arm 31, beyond its connection to rod 29, projects through opening 39*a* formed at the upper end of vertical chamber 29 facing rearwardly, that is, toward mattress M, as seen in FIGS. 3 and 4. The rear end of arm 31 supports paddle 35 which may be of rectangular configuration having rounded corners and extends symmetrically on opposite sides of arm 31. Arm 31 may be a rigid structure but, as shown in FIGS. 4 and 6, preferably is sectionalized to comprise front and rear sections 32 and 33, respectively. Front section 32 extends from the front end pivoted on pin 31*a*, beyond the connection to rod 29, through opening 39*a* and has a pivotal connection to rear section 33 which includes pin 31*b* and suitable means for limiting the pivotal or hinged movement of rear section 33 with respect to front section 32 to a downward direction from a longitudinally aligned position wherein sections 32 and 33 move together in depressing paddle 35 into mattress M.

Protective shield 36, seen in FIG. 1 to be of rectangular shape sized to extend beyond the edges of paddle 35, may be made of pliable transparent plastic sheet material and is attached to the top wall of vertical chamber 39 by suitable means, such as, a cover plate 39*b* secured by a plurality of screws 39*c*.

Control box 22 contains on/off switch 22*a*, which operates in combination with a timer, and a speed control for motor 26. Knob 23 indexed to scale 23*a* provides for selective adjustment of the timer and knob 24 indexed to scale 24*a* enables selection of a desired RPM for drive shaft 27 and hence the rate of reciprocation of paddle 35 and the frequency of waves W.

Figure 2:
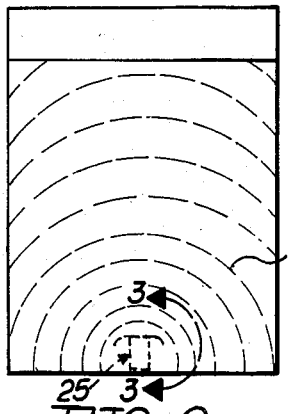
FIG. 2 is a plan view of a waterbed having the accessory shown in FIG. 1 installed at the edge of the mattress along the foot of the bed, the waves generated by the accessory being shown in broken lines.

The operation of accessory 20 will now be apparent. Motorized paddle unit 25 is installed by placing bottom wall 37*a* of housing 37 on the mattress supporting base board B so that vertical chamber 39 rests against one of the side panels P of the bed frame, preferably at a midportion between adjacent corners seen in FIG. 2 as against the panel P extending along the foot of the bed. The configuration of mattress M readily distorts to accommodate and conform to base chamber 38 and vertical chamber 39 so that paddle 35 will rest in operative position beneath protective shield 36 on the upfacing surface of mattress M adjacent the distorted edge thereof, as will be clear from FIG. 3. Wiring 21 extends from paddle unit 25 and may be placed to provide easy accessibility to control box 22 by a person reclining on mattress M. After connecting plug 21*b* to a house socket, placing switch 22*a* in "on" position actuates motor 26 which, through reduction gearing 28, drive shaft 27, crank 27*a* and connecting rod 29, pivots section 32 of arm 31 on pivot pin 31*a* to swing in a vertical plane between the horizontal position shown in full lines in FIG. 4 and the downwardly inclined position indicated in broken lines.

As will be clear from FIGS. 3 and 4, each downstroke of connecting rod 29 pulls axially aligned arm sections 32 and 33 to a downwardly inclined position whereby paddle 35 depresses mattress M initiating each wave W. The upstroke of connecting rod 29, when the latter is a rigid structure, returns arm section 32 to its horizontal position, releasing mattress M to return to its normal configuration thereby raising paddle 35 and rear arm section 33 preparatory to the next stroke. The pivotal attachment of arm section 33 to section 32 permits paddle 35 to move downwardly, independent of arm section 32, thereby preventing the application of undue stress to paddle assembly 30 in the event downward pressure is inadvertently applied to paddle 35.

It will be apparent that connecting rod 29 may alternatively be made of flexible material, as for example, a multi-strand cable provided at opposite ends with suitable eyelets for its pivotal connections. With such flexible connecting rod 29, only the downstroke imparts positive movement to paddle assembly 30. The resiliency of mattress M returns arm 31 and paddle 35 to a normally raised position between each downstroke of connecting rod 29.

Figure 8:
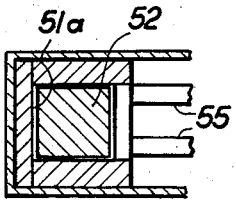
FIG. 8 is a sectional view taken on line 8—8 in FIG. 6 showing details of the vertical slide portion of the drive connection.
Figure 7:
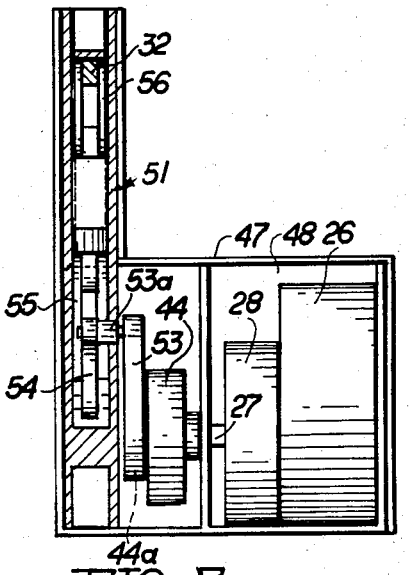
FIG. 7 is a sectional view taken on line 7—7 in FIG. 6.

Paddle unit 45 is shown in FIGS. 6, 7 and 8 as a modification of unit 25 in which connecting rod 29 is replaced by lever and slide connector assembly 50 enabling the constriction of the vertical chamber to require less displacement of mattress M. Paddle unit 45 has motor 26, reduction gearing 28 and drive shaft 27 as well as paddle assembly 30 which all operate in similar fashion to those in paddle unit 25. Housing 47 of unit 45 has a lower chamber 48 and a vertical chamber 49 which corresponds in depth at the upper end thereof in the region of opening 49*a* to the uniform depth of vertical chamber 39 but has a constricted portion adjacent lower chamber 48. The stanchion 51, which at its upper end supports paddle assembly 30 with pivot pin 31*a*, serves as a combination track and stanchion having a track 51*a* in a midportion thereof in which vertical slide 52 reciprocates.

Slide connector assembly 50 is driven by a flywheel 44 mounted to rotate with drive shaft 27, flywheel 44 having an eccentric pin 44*a* on which a lower end of lever 53 pivots. The upper end of lever 53 carries pin 53*a* to which the upper end of fixed lever 54 pivotally connects, the lower end of lever 54 being anchored for pivotal movement to stanchion 51 by a pivot pin 54*a*. An intermediate lever 55 extends between a midportion of fixed lever 54 and the lower end of vertical slide 52, and is connected thereto for appropriate pivotal movement by pins 55*a* and 55*b*, respectively. The upper end of vertical slide 52 connects by pivot pin 56*a* to upper lever 56, the opposite end of which in turn pivotally connects to front section 32 of arm 31. As seen in FIGS. 7 and 8, levers 55 and 56 may each comprise a pair of spaced parallel sections between which the connecting parts fit to eliminate torque.

In operation, vertical reciprocation is imparted to vertical slide 52 by the coaction of levers 53, 54 and 55, lever 53 being eccentrically driven by flywheel 44. In turn, vertical slide 52 by lever 56 lowers and raises paddle assembly 30.

Frequencies of oscillation of paddle 35 and hence those of waves W between 40 and 55 cycles per minute provide users reclining on mattress M with the desired pleasant sensations which also are particularly useful in inducing sleep, a frequency of about 50 CPM having been found to render optimum results. Accordingly, reduction gearing 28 cooperates with motor 26 to drive shaft 27 at a corresponding range of RPMs under suitable control and selective adjustment by knob 24 and appropriately calibrated scale 24*a*. The timer, likewise, selectively adjusted by knob 23 in accordance with scale 23*a*, enables motor 26 to be shut-off after the user falls asleep. Both speed control and timer, which are contained within control box 22, may be of conventional constructions well known in the art.

It will be understood that pivot pin 31*a*, which supports paddle assembly 30 in units 25 and 45, may be mounted on any suitable means, for example, on housings 37 and 47, respectively, which housings may be reinforced for the purpose. This will result in eliminating stanchion 30*a* from unit 25 and modifying combination track and stanchion assembly 51 in unit 45 to merely provide a guide means or track for vertical slide 52.

The parts of paddle units 25 and 45 may be made of any suitable metal or plastic material or combinations thereof. Paddle 35, rendering satisfactory results when made approximately 4 inches wide and 8 inches long, may be attached to rear arm section 33 by suitable fastening means (not shown) or, when molded of plastic, the parts may be integrally formed.

The wave generating accessories for waterbeds herein disclosed are seen to achieve the several objects of the invention and to be well adapted to meet conditions of practical use. As various possible embodiments might be made of this invention, and as various changes might be made in the disclosed accessories, it is to be understood that all matters herein set forth or shown in the accompanying drawings are to be interpreted as illustrative and not in a limiting sense.

What is claimed is:

1. A wave generating paddle unit a waterbed assembly, comprising a horizontal surface supporting a water-filled mattress and a frame surrounding the periphery of the mattress, said unit comprising a housing having a bottom wall adapted to rest in an operative position on said horizontal surface, said housing having a vertical wall enclosing a vertical chamber and adapted to abut said frame and dislodge an edge portion of said mattress when in said operative position, an opening formed in said wall at the upper end of the vertical chamber facing said mattress, an electric motor located within said housing and supported on said bottom wall, an arm pivoted at one end to a support means at the upper end of said vertical chamber and having an opposite end projecting through said opening, a paddle supported by said arm opposite end adapted to overlie and engage the upper surface of said mattress adjacent said edge portion, and linkage drive means for converting rotary motion of said motor to reciprocating motion, said drive means extending through said vertical chamber interconnecting said motor and arm to pivot the latter in a vertical plane between a substantially horizontal position and a downwardly inclined position whereby said paddle rhythmically depresses and releases said mattress to create waves in the surface thereof radiating from said paddle.

2. The assembly defined in claim 1 in which said arm is sectionalized as a front and rear section pivotally connected in longitudinal relation, the front section having said end pivoted to said support, the rear section supporting said paddle and being adapted to move downwardly when propelled by said front section in an axially disposed position and otherwise free to pivot downwardly with respect to said front section, said linkage drive means being connected to said front section for said pivoting of the arm.

3. The assembly defined in claim 1 in which said linkage drive means comprises an eccentric rotated by said motor and a pitman connecting said eccentric to a midportion of said arm.

4. The assembly defined in claim 3 in which said pitman is rigid for a positive reciprocating drive of said arm.

5. The assembly defined in claim 3 in which said pitman is flexible for a positive drive of said arm solely on the downstroke.

6. The assembly defined in claim 1 in which said vertical chamber is constricted at a midportion thereof to minimize said mattress dislodgement and said linkage drive means comprises an eccentric rotated by said motor, a slide mounted to vertically reciprocate within said vertical chamber constriction, coacting levers connecting a lower end of said slide to said eccentric for reciprocation thereby, and a lever pivotally connecting an upper end of said slide to a midportion of said arm.

7. The assembly defined in claim 1 in which said vertical chamber has a top wall, a protective shield secured to said top wall above said paddle and being sized to overlap the latter and rest on said mattress.

8. The assembly defined in claim 1 including electric wiring for said motor extending from said housing and terminating in a plug, a control box interposed along said wiring between said motor and said plug containing an on/off switch for said motor, said wiring being of a length sufficient to locate said control box for easy access by a user reclining on said mattress when the paddle unit is in operative position on said horizontal surface.

9. The assembly defined in claim 8 in which said control box houses a speed control for said motor having a knob and a calibrated scale for selecting the desired frequency of said waves.

10. The assembly defined in claim 8 in which said control box houses a timer coacting with said on/off switch for shutting off power to said motor at a predetermined time interval, said timer having a knob and scale for selecting said time interval.

11. A wave generating paddle unit and waterbed assembly, comprising a horizontal surface supporting a water-filled mattress and a frame surrounding the periphery of the mattress, said unit having a horizontal disposed paddle adapted to overlie and engage the upper surface of said mattress when the unit is in operative position on said horizontal surface, a portion of the unit extending vertically between said frame and an edge of the mattress to locate said paddle in said mattress engaging position, the mattress being distorted to accommodate the contour of said unit, the latter being concealed within the confines of said frame, an electric motor contained in said unit operating a drive means oscillating said paddle between a horizontal position and a downwardly inclined position whereby said paddle rhythmically depresses and releases said mattress to create waves in the surface thereof radiating from said paddle.

12. The assembly defined in claim 11 including electric wiring for said motor extending from said unit and terminating in a plug, a control box interposed along said wiring between said motor and plug containing a speed control for said motor having a knob and a calibrated scale for selecting frequencies of oscillation of said paddle ranging between 40 and 55 cycles per minute.

13. The assembly defined in claim 11 in which the downward stroke of the paddle is a positive action by said drive means and the upward stroke is accomplished by the resiliency of the mattress.

* * * * *